United States Patent [19]

Allegri, Sr.

[11] 4,071,302

[45] Jan. 31, 1978

[54] AISLE DESIGNATORS

[76] Inventor: Theodore Henry Allegri, Sr., 5617 Fairmont, Peoria, Ill. 61614

[21] Appl. No.: 720,300

[22] Filed: Sept. 22, 1976

[51] Int. Cl.[2] ..... E01F 9/08

[52] U.S. Cl. ..... 404/12

[58] Field of Search ..... 404/12, 13, 14, 15, 404/16, 9

[56] References Cited

U.S. PATENT DOCUMENTS

| | | | |
|---|---|---|---|
| 1,606,825 | 11/1926 | Briggs | 404/12 |
| 1,661,242 | 3/1928 | Truxal | 404/12 |
| 1,981,206 | 11/1934 | Strauss | 404/16 X |
| 1,990,518 | 2/1935 | Benoit | 404/16 X |
| 2,015,031 | 9/1935 | Fischer | 404/15 |
| 2,142,803 | 1/1939 | Robertson | 404/16 |
| 2,225,496 | 12/1940 | Gethin | 404/12 |
| 2,627,784 | 2/1953 | Pellar | 404/16 |
| 2,635,513 | 4/1953 | Batterson | 404/15 |
| 2,662,769 | 12/1953 | Madsen | 404/9 X |
| 3,096,694 | 7/1963 | Lynn | 404/15 |
| 3,114,597 | 12/1963 | Lee | 404/15 X |

*Primary Examiner*—Nile C. Byers

[57] ABSTRACT

This invention relates to the designation of aisles by providing a visual device for separating horizontal, vertical, or inclined spaces. In warehouse set-out areas merchandise or traffic patterns can more nearly be controlled by the use of this invention in designating these set-out spaces. In factories, safety aisles for pedestrian or vehicular traffic may, also, be more readily controlled by the use of the aisle designators described in these specifications. Also, on highways or where automobiles, trucks, and buses must travel the use of this invention can more safely guide the paths of travel by designating the aisles of movement.

3 Claims, 15 Drawing Figures

AISLE DESIGNATORS

SUMMARY OF THE INVENTION

This invention relates to the designation of aisles as in warehouses, distribution centers, factories, on highways, and in parking lots.

An object of this invention is to provide an aisle marker for concrete, asphaltic, and wood-block surfaces.

Another object of this invention is to groove the surface into which the aisle designator is implanted so that there is a high shear resistance which will tend to minimize its displacement.

A further object of the invention is to provide a number of surfaces at right angles to each other in the area where a bond is effected so that the surfaces in contact with each other are maximized.

Another object of the invention is to produce an aisle designator in a multiplicity of colors and to have contrasting colors spell out words by means of letters implanted in the aisle designator.

Still another object of the invention is to have an inspection and bleeding hole in the aisle designator that will permit air to be evacuated from the underside of the designator as it is bonded to the surface to which it is applied; and, also, to serve as an inspection hole which will indicate if it is properly bonded to the surface to which it is applied; and, to expel any superfluous bonding adhesive from the underside of the designator; and, to provide a means by which the solvents from the bonding material may evaporate rapidly.

Other objects and advantages of this invention will be apparent from the following detailed description, taken in connection with the accompanying drawings wherein I have shown the preferred form in which I have contemplated applying the principles of the invention.

Referring to the drawings.

Figure 1:
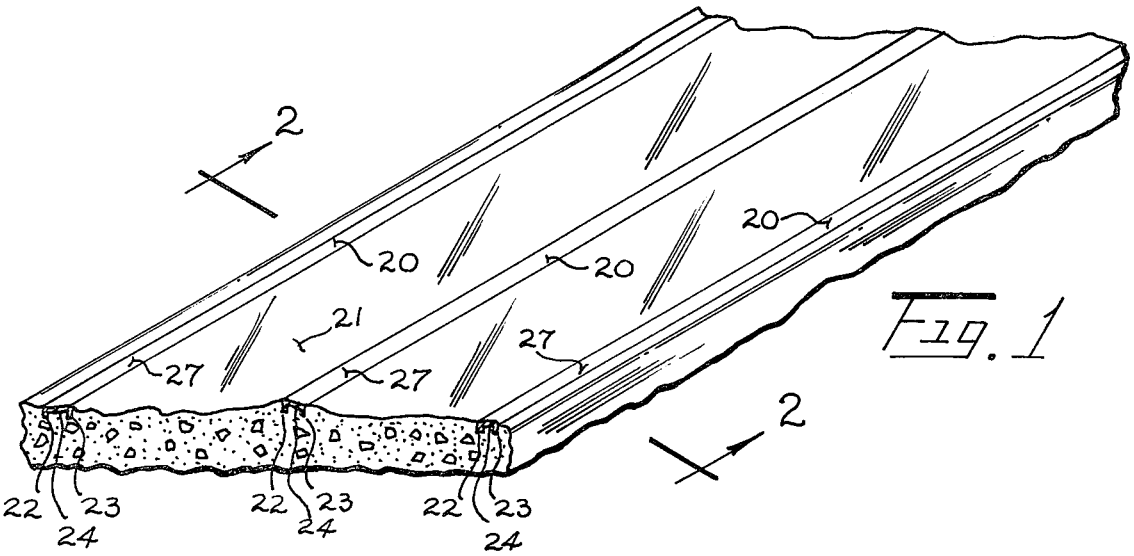
FIG. 1 is a view showing a two-lane highway with dividing aisle designators in the middle and on the two outward edges of the roadway.

Referring to the drawings in detail and first particularly to FIG. 1:

FIG. 1 being a view showing an aisle designator 20 in a continuous, extruded form with a channel-like cross-section. The aisle designator may be imbedded in newly laid concrete 21, or asphalt, but it may, also, be placed in old road surfaces and wood-block floors by first making two sawcuts 22 and 23, and grinding the intermediate space 24.

Figure 2:
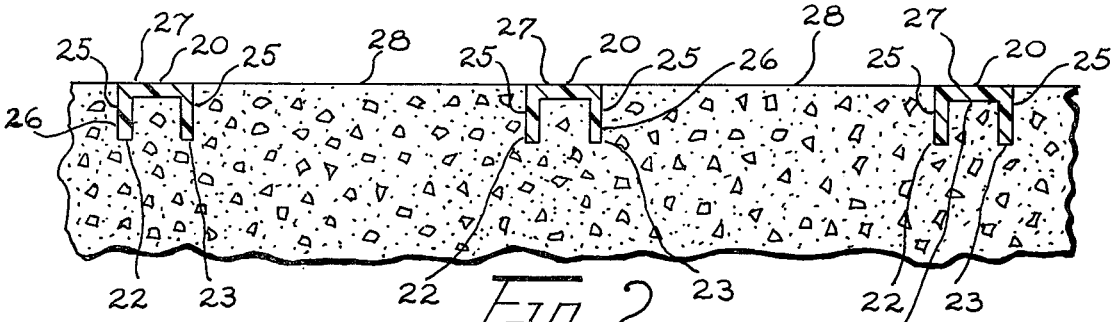
FIG. 2 is a front elevational view of the aisle designators imbedded in the surface of a roadway.

FIG. 2 is a front elevational view of the continuous, extruded form of aisle designator 20. The two legs 25 are placed in the saw cuts 22 and 23. Before placing the legs 25 into the saw cuts 22 and 23, all contacting surfaces 26 are coated with a bonding adhesive. It will be noted that the top surface 27 of the aisle designator 20 is flush with the surface of the roadway 28 in order to present the least possible shear interference with moving vehicular traffic, sweepers, or snow removal equipment and the like.

Figure 3:
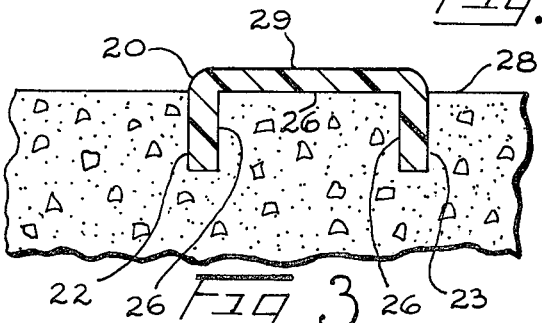
FIG. 3 is a front elevational view of one form of aisle designator showing its topmost surface as raised above the roadway.

FIG. 3 is a front elevational view of one form of aisle designator 20 showing its topmost surface 29 raised above the roadway 28. In imbedding this type of aisle designator 20 into a roadway 28 it is first necessary to make two sawcuts 22 and 23. Bonding adhesive is then applied to all contacting surfaces 26 and the aisle designator 20 is then imbedded into the roadway 28.

Figure 4:
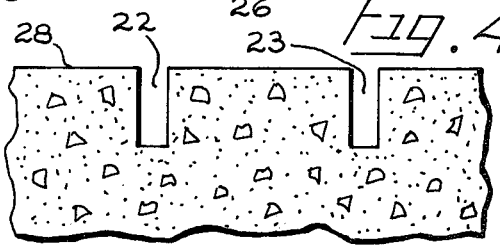
FIG. 4 is a front elevational view of a section of roadway showing the grooves in which the aisle designator is placed.

FIG. 4 is a front elevational view of a section of roadway 28 showing the two sawcuts 22 and 23.

Figure 5:
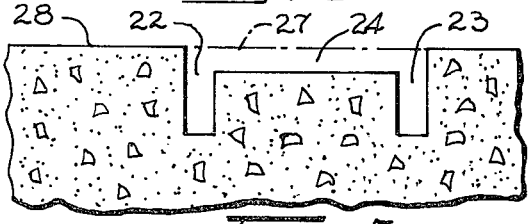
FIG. 5 is a front elevational view of an alternate method of imbedding the aisle designator so that its topmost surface is flush with the roadway as is shown in FIGS. 1 and 2.

FIG. 5 is a front elevational view of an alternate method of imbedding the aisle designator 20 in a roadway 28 so that its top surface 27 as shown in FIGS. 1 and 2, is flush with the surface of the roadway 28. The two sawcuts 22 and 23 are made and the intermediate space 24 is ground down to permit the top surface 27, of FIGS. 1 and 2, to become flush with the roadway 28.

Figure 6:
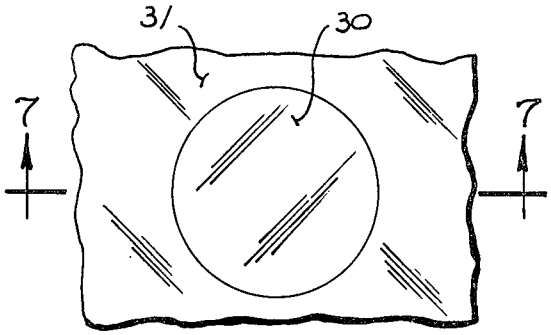
FIG. 6 is a top view of a round aisle designator in a roadway.

FIG. 6 is a top view of a round aisle designator 30 which is flush-mounted in any type of surface 31.

Figure 7:
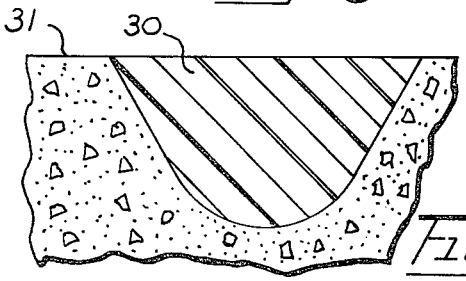
FIG. 7 is a side sectional view of the round isle designator shown in FIG. 6.

FIG. 7 is a side sectional view of a round aisle designator 30 which may be flush-mounted in any type of surface 31. The surface 31 shown in FIG. 7 could be concrete, asphalt, wood-block, ceramic, masonry, or any type of surface that can be drilled or hollowed-out to receive this type of round aisle designator 30.

Figure 8:
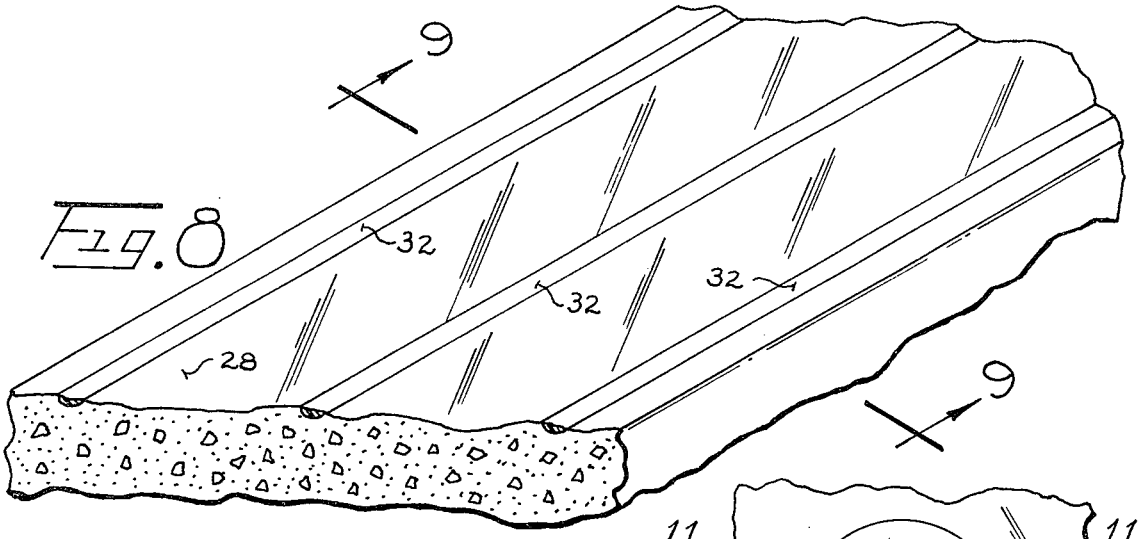
FIG. 8 is a top sectional view of another type of aisle designator for roadways.

FIG. 8 is a top sectional view of another type of continuous-filament aisle designator 32. This view illustrates a means for flush-mounting a continuous filament in any type of roadway 28.

Figure 9:
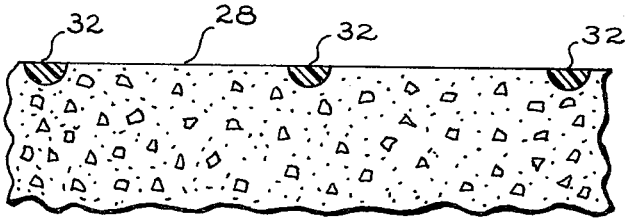
FIG. 9 is a front elevational view showing the middle and side aisle designators in a roadway.

FIG. 9 is a cross-sectional and front elevational view of the continuous filament aisle designator 32 in a concrete roadway 28, showing its capability of being imbedded flush with an adhesive in the surface of the roadway 28.

Figure 10:
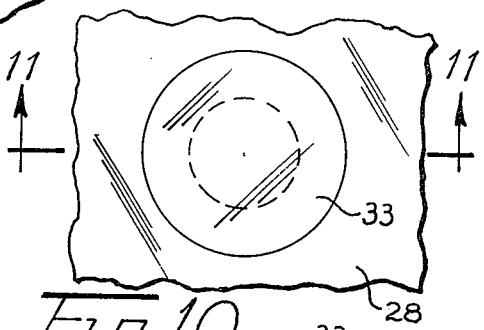
FIG. 10 is a top view of a round aisle designator of a plug type in a roadway.

FIG. 10 is a top view of a round plug aisle designator 33 flush-mounted in a roadway 28.

Figure 11:
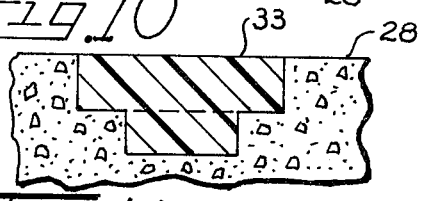
FIG. 11 is a front elevational view of a round plug aisle designator in a roadway.

FIG. 11 is a front elevational view of a round plug aisle designator 33 mounted flush with an adhesive in the surface of the roadway 28.

Figure 12:
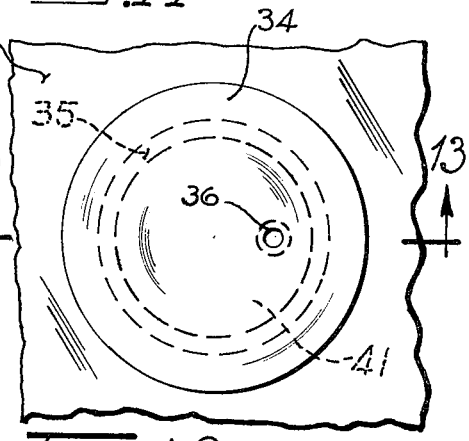
FIG. 12 is a top view of a round groove aisle designator in a road surface.

FIG. 12 is a top view of a round groove aisle designator 34 in a roadway 28. The round groove 35 may be seen as concentrically disposed about the round groove aisle designator 34 in the roadway 28. There is a hole 36 which serves several purposes, viz.: it permits inspection so that the bonding agent, an adhesive, may be seen and to assure that it has been thoroughly applied to the undersurface 41 of the round groove aisle designator 34; the hole 36, also, serves as a means for breaking the vacuum of entrapped air on the undersurface 41 of the round groove aisle designator 34; the hole 36 permits the rapid evaporation of the solvents in the adhesive which is used to bond the round groove aisle designator 34 to the surface of the roadway 28.

Figure 13:
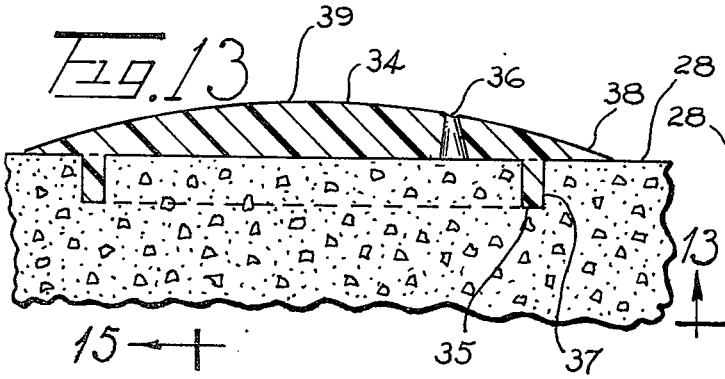
FIG. 13 is a side elevational view of a round groove aisle designator showing the shear elements and the inspection hole.

FIG. 13 is a side elevational view of the round groove aisle designator 34, showing the hole 36 and the ring flange 37, which is imbedded by means of an adhesive in the groove 35. The tapered edge 38 forms an additional shear advantage or resistance to the overturning moment imposed by the movement of vehicular traffic on the upper surface 39. The ring flange 37 resists horizontal shear forces by transmitting these forces against the groove 35 in the roadway 28.

Figure 14:
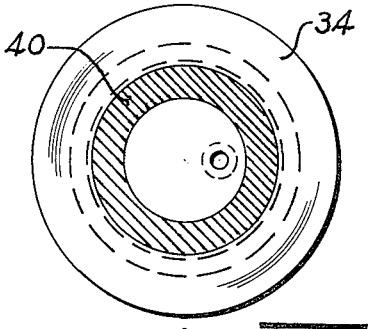
FIG. 14 is a top view of a round groove aisle designator showing a contrasting, colored letter "O" implanted in its crown.

FIG. 14 is a top view of a round groove isle designator 34 showing a shaded area 40 representing the alphabetic letter "O", which has been cast into the plastic structure of the round groove aisle designator 34.

Figure 15:
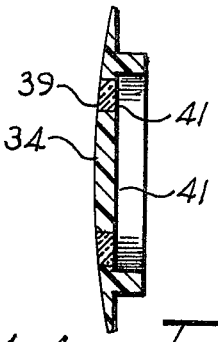
FIG. 15 is a side elevational view of a round groove aisle designator with shear elements and the continuous imbedment of the letter "O" in its crown.

FIG. 15 is a side elevational view of a round groove aisle designator 34 showing how the plastic structure has been thoroughly penetrated by the different colored plastic of the letter "O" from the upper surface 39 to the undersurface 41.

While specific forms of the invention have been described and illustrated herein, it is desired to be understood that the same may be varied within the scope of the appended claims, without departing from the spirit of the invention.

What is claimed is:

1. An aisle designator for use with a surface having a groove structure formed therein, said aisle designator comprising:

indicator means having first and second surfaces and a peripheral edge, said first surface being convex in conformation, said second surface being planar, said peripheral edge being formed by the juncture of said first and second surfaces, said peripheral edge defining a circle, said indicator means having an axis of symmetry normal to said second surface and intersecting the center of said circle, said indicator means having a bore formed therethrough, said bore having a bore longitudinal axis normal to said second surface and offset from said axis of symmetry toward said peripheral edge;

anchor means having an annular configuration, said anchor means being attached normal to said second surface, the longitudinal axis of said anchor means being aligned with said axis of symmetry, said anchor means having a cross-sectional diameter less than the diameter of said circle, said second surface having an interior bearing portion and a peripheral bearing portion defined by said anchor means; and the groove structure being annular in conformation and normal to the surface, said anchor means fitting flush within the groove structure, said interior and peripheral bearing portions fitting against said surface.

2. An aisle designator as defined in claim 1 and further wherein said bore has a cross-sectional dimension continuously increasing from said first surface toward said second surface.

3. An aisle designator as defined in claim 2 and further wherein said indicator means has impregnated therethrough coloring material, said material extending between said first and second surfaces, said material being bounded by longitudinal surfaces parallel to said axis of symmetry, whereby a marking is formed.

* * * * *